United States Patent [19]

Carydias et al.

[11] Patent Number: 4,512,121

[45] Date of Patent: Apr. 23, 1985

[54] HANDLING SYSTEM FOR PRECAST UNITS

[76] Inventors: Roger Carydias, 331 Demers St., Sainte-Rose, Laval, Province of Quebec, Canada, H7L 3C3; Chahan Pacradouni, 2320 Captain Bernier, Montreal, Canada, H3M 1W5

[21] Appl. No.: 497,607

[22] Filed: May 24, 1983

[51] Int. Cl.[3] ..... E04G 21/12; E04C 5/16

[52] U.S. Cl. ..... 52/125.2; 52/125.5; 52/127.5; 52/707

[58] Field of Search ..... 52/707, 710, 698, 711, 52/125.1, 125.2, 125.4, 125.5, 127.5, 235

[56] References Cited

U.S. PATENT DOCUMENTS

| | | | |
|---|---|---|---|
| 1,037,142 | 8/1912 | Hazen | 52/698 |
| 2,952,047 | 9/1960 | White . | |
| 2,954,647 | 10/1960 | Lee . | |
| 3,712,014 | 1/1973 | Waerner | 52/711 |
| 4,085,556 | 4/1978 | Sonneville | 52/710 |
| 4,088,361 | 5/1978 | Ditcher | 52/707 |
| 4,182,092 | 1/1980 | Weaver | 52/707 |

FOREIGN PATENT DOCUMENTS

| | | | |
|---|---|---|---|
| 154487 | 12/1913 | Canada . | |
| 878242 | 8/1971 | Canada . | |
| 907348 | 8/1972 | Canada . | |
| 347042 | 1/1922 | Fed. Rep. of Germany | 52/707 |
| 29749 | of 1913 | United Kingdom | 52/707 |

*Primary Examiner*—James L. Ridgill, Jr.

[57] ABSTRACT

A small reinforced cavity is made in the precast unit and opens at the surface of the unit through a restricted slot. An anchor member, having a transverse leg at its inner end, is inserted through the slot and rotated to 90° in secured position, so that the transverse leg will engage the surface of the cavity. The anchor member is firmly retained in secured position within the cavity. The outer end of the anchor member is either directly attached to a building structure for anchoring the precast unit in permanent position, or is fitted with a ring for use in hoisting and/or transporting the precast unit. The anchor member can be re-used. At least one safety pin is connected to the anchor member and is adapted to engage the slot to maintain the anchor member in its 90° secured rotated position.

5 Claims, 19 Drawing Figures

HANDLING SYSTEM FOR PRECAST UNITS

FIELD OF THE INVENTION

The present invention relates to a handling system for precast units, such as reinforced prefabricated concrete panels, and the like. The handling system serves both for hoisting and transporting the precast units and for attaching these units to the structure of a building or the like.

Conventional systems for the handling of prefabricated units, such as reinforced prefabricated concrete panels, beams and the like, consist of providing loops of steel cables embedded in the concrete and used for the hoisting transportation of the precast units. Anchoring bolts or plates are also embedded in the units for attaching the panels or beams to a building structure. At the erection site, the loops of steel cables must be cut off and the pockets surrounding these loops must be filled with mortar or the like. The anchoring bolts or plates for fixing the panels, for instance building facing panels, do not permit removal of the fixed panels without destroying the same. Therefore, these panels cannot be removed, for instance if an addition to the building must be effected.

Also, the conventional anchoring bolts and plates form a rigid anchorage system which does not allow for contraction and expansion of the precast units under temperature changes, with the result that these units often crack. The anchorage system also does not allow for movement due to earthquakes.

OBJECTS OF THE INVENTION

It is therefore the general object of the invention to provide a handling system for precast units, which overcomes the above-noted disadvantages.

A more specific object of the invention is to provide such a system in which the portion associated with the precast units are used both for hoisting the units during their manipulation and transportation and for attaching the units to a building structure for final erection.

Another object of the present invention is to provide a system of the character described, in which the anchor members used for hoisting the precast units can be re-used.

Another object of the invention is to provide a system of the character described, in which the precast units, once attached to the building structure, can be detached without destroying the same, so that they may be re-used.

Another object of the invention is to provide a system of the character described, which allows movement of the attached units relative to the supporting building structure, so as to allow for temperature-caused contraction and expansion and to better resist to earthquakes.

Still another object of the invention is to provide hardware for the purpose described, which is inexpensive and simple to manufacture and which permits great savings with respect to the conventional systems in the handling and attaching of the precast units.

SUMMARY OF THE INVENTION

The handling system of the invention comprises a reinforced cavity formed in the precast unit and opening at an exposed face thereof through a restricted slot. An anchor member, having a transverse leg at its inner end, is insertable through the slot and then rotated through about one-quarter turn, so that the leg engages the cavity transversely of the slot. Preferably, means are provided to positively maintain the anchor member in rotated cavity-engaging position. For hoisting and transporting the precast units, the anchor member is fitted with a ring; for attaching the precast units to a building structure, the anchor member has a bent end adapted to be directly attached to said building structure.

The foregoing will become clearer by referring to the annexed drawings, in which:

DETAILED DESCRIPTION OF THE PREFERRED EMBODIMENTS

Figure 1:
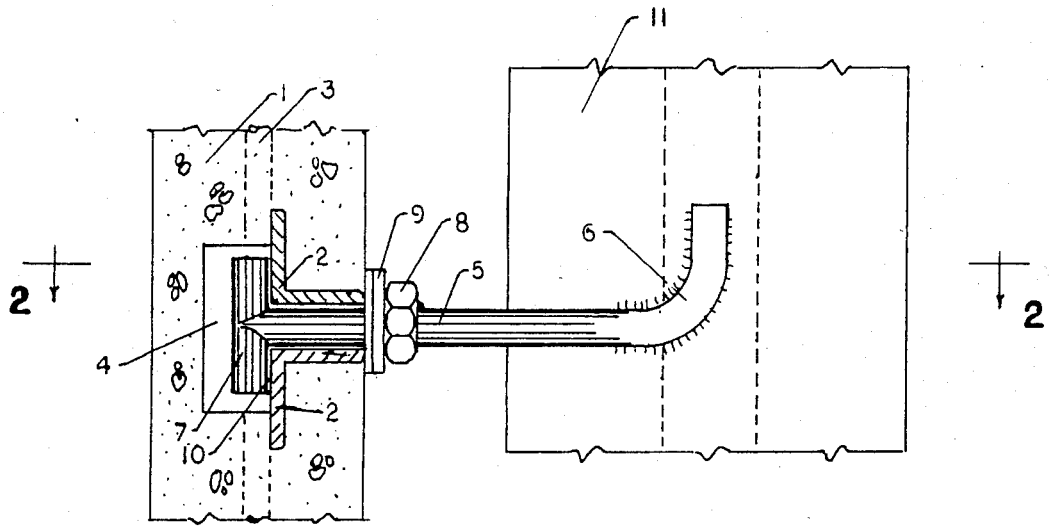
FIG. 1 is a sectional view of a first embodiment of the system of the invention used to attach a precast unit to a building structure, said view being taken along line 1—1 of FIG. 2.
Figure 2:
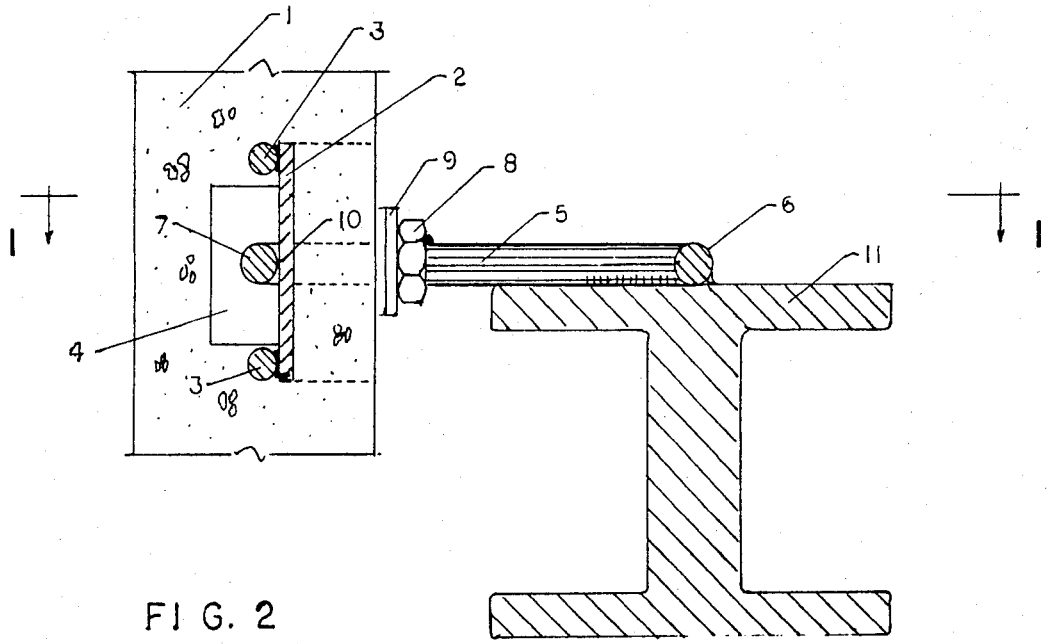
FIG. 2 is a section taken along line 2—2 of FIG. 1.

FIGS. 1 and 2 show a precast unit 1 which may be a prefabricated reinforced concrete panel, a structural concrete beam or the like. A pair of right angle short bars 2 are embedded in the concrete and secured, as by welding, to reinforcing rods 3. The right angle bars 2 are arranged in parallel relationship with lateral wings extending in opposite direction within the concrete and with the other wings perpendicular to the exposed surface of the precast unit 1. A cavity 4 is formed in the precast unit and is in communication with the exterior through a restricted slot as defined by the angle bars 2. Therefore, the slot is of elongated shape and the cavity 4 is wider than the slot as shown in FIG. 1. The angle bars 2 are exposed within the slot and the cavity. An anchor member 5, in the form of a straight rod, is formed with a bent outer end 6 and with an integral transverse leg 7 at its inner end. Said leg 7 forms a T-shape head with the shank of the rod. The anchor member 5 has a diameter slightly smaller than the width of the slot between the two angle bars 2, so that it may be inserted within the cavity and then the anchor member is rotated through substantially 90°, so that the transverse leg 7 will extend transversely of the slot, as shown in FIGS. 1 and 2, to fasten the anchor member 5 to the precast unit 1. The rod 5, which is threaded, carries a nut 8, or collar, together with plastic washer and a steel washer 9, which are applied tight against the exposed surface of the unit 1 after the anchor bolt is in secured position. The collar 8 is preferably tack-welded to the anchor member 5.

Supposing the precast unit 1 is an external facing panel for a building, the bent end 6 of the anchor member 5 is simply welded to a steel beam 11, or to a metal plate (not shown) embedded in a concrete beam of the building structure.

In the case the panels are much longer than wide, which is the conventional format, the slot between the angle bars is arranged to be vertically disposed, as shown, so as to allow ample relative movement in the vertical direction of the anchor member with respect to the panel 1 to compensate for temperature differentials between the panel 1, which is exposed to the exterior, and the supporting structure or beam 11. A certain play also exists between anhcor member 5 and the angle bars 2 transversely of the latter.

The relative orientation of the T-shape head 7 and of the bent end 6 of anchor member 5 is such that the transverse head 7 will have to take its rotated anchoring position when the bent end 6 is fixed to the beam 11, so as to prevent any mistake by the worker at the erecting site.

FIGS. 14, 15, and 16, 17, respectively show two different orientations of the bent end 6 of the anchor member with respect to the T-shape head 7 for fixing to a horizontal and to a vertical beam, respectively.

Figure 8:
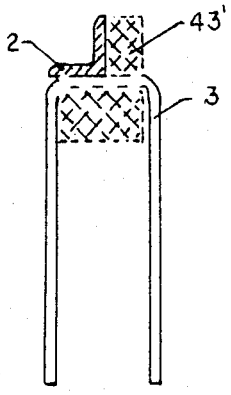
FIGS. 8 to 13 are sectional views of two different shapes of the reinforced cavities formed in the precast unit, together with various types of reinforcing rods associated therewith.
Figure 9:
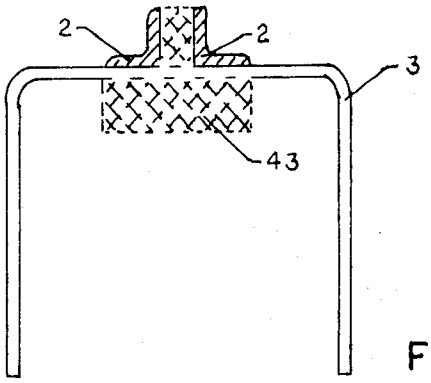
Figure 10:
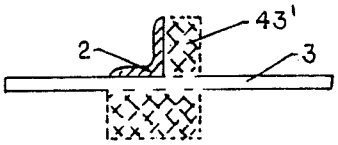
Figure 11:
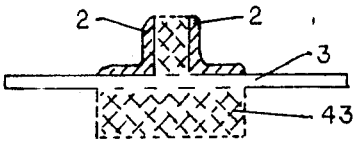
Figure 12:
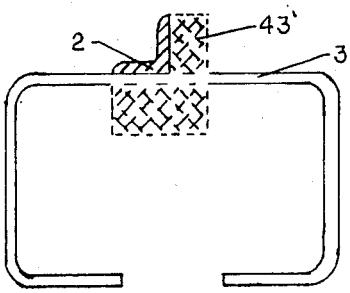
Figure 13:
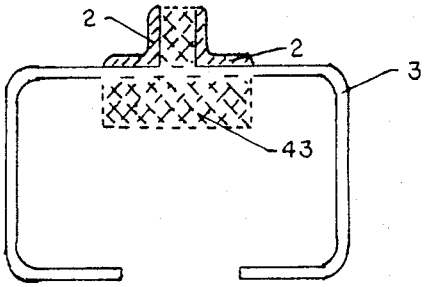
Figure 14:
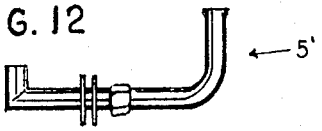
FIGS. 14 to 19 are views of different shapes of anchoring member.
Figure 15:
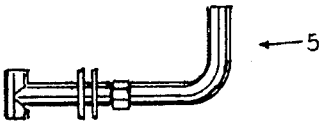

Instead of a T-shape head, the inner end of the anchor member 5 may form a single laterally-extending leg, as shown in FIGS. 12 and 13. This is suitable for panels or precast units of smaller dimensions and weight. In this case, only one angle bar 2 is provided, as shown in FIGS. 8, 10, and 12, and the shape of the cavity 4 is as shown at 43' in these figures.

FIGS. 8 to 13 also show that the reinforcing rods 3 may have any conventional shape to be firmly embedded in the concrete.

These figures show also how the cavities 4 or 43', whether for a double-leg head or a single-leg head of the anchoring members, are formed in the concrete during pouring. For this purposes, once the angle bars 2, with the reinforcing rods 3, have been properly positioned in the molding form prior to concrete pouring, a block of polystyrene foam, as indicated at 43, is positioned between the two angle bars 2, this block having the shape of the cavity and of the communicating slot. The concrete is then poured and, once set, the block of polystyrene foam 43 is simply dissolved by using a proper solvent, such as methyl chloride, kerosene or benzine. As an alternative, the polystyrene foam 43 can be burned by applying suitable heat. The block of polystyrene foam may be replaced by polyurethane foam.

Figure 3:
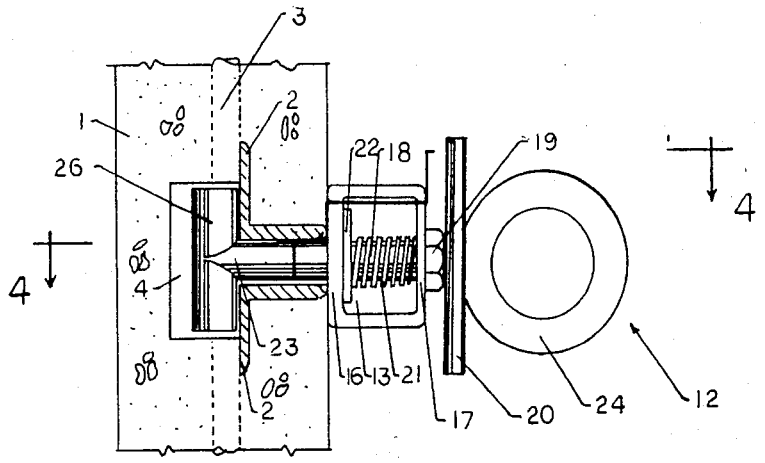
FIG. 3 is a sectional view of a second embodiment used for hoisting and transporting the precast unit, said view being taken along line 3—3 of FIG. 4.
Figure 4:
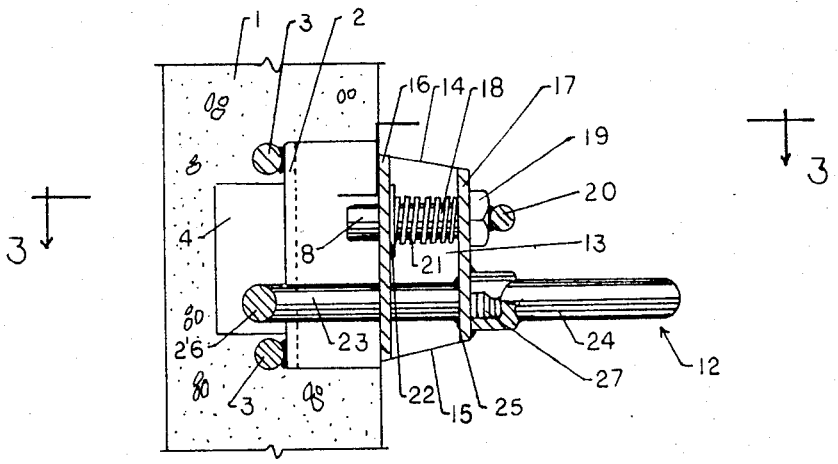
FIG. 4 is a section taken along line 4—4 of FIG. 3.

The same reinforced cavity just described for the precast unit 1 is used for lifting and transporting the units. A first embodiment of the lifting and hoisting system is shown in FIGS. 3 and 4.

The lifting device is generally indicated at 12 and includes a short tubular member 13, of generally rectangular cross-section, having bevelled ends 14 and 15 and defining a base 16 and a top 17. Base 16 is adapted to be applied flat against the exposed face of the concrete unit 1. A safety pin 18 extends through aligned holes of the base 16 and top 17, and is provided with a head section 19 to which is secured a transverse grasping rod 20. Head 19 overlies top 17. A compression spring 21 surrounds the safety pin 18 intermediate the base 16 and top 17 and abuts at one end against a washer 22 which is welded to safety pin 18 while the other end of compression spring 21 abuts against the inside of top 17. Thus, the pin 18 is always biased by spring 21 to a position protruding from the underside of base 16.

An anchor member 23, equivalent to the anchor member 5 of the first embodiment, extends through aligned holes of tubular member 13 and is welded or otherwise rigidly secured to base 16 and top 17. The end of anchor member 23 has an integral T-shaped head 26, similar to the T-shaped head 7 of the first embodiment and this head is oriented so as to extend at right angle to the plane containing the safety pin 18 and anchor member 23. The outer end of the anchor member 23 which protrudes from the top 17 is threaded, as shown at 27, and screwed into a threaded bore of a hoisting ring 24.

To attach lifting device 12 to the precast unit 1, the safety pin 18 is raised by means of grasping rod 20 until its inner end is at least flush with base 16 and the tubular member 13 is oriented transverse to the slot of cavity 4, so as to insert the T-shaped head 26 within the slot and into the cavity 4. Then the ring 24 is rotated, together with tubular member 13, so as to position the transverse leg of head 26 across the slot and, at the same time, the safety pin 18 becomes aligned with the slot and is released to protrude within the slot. Therefore, safety pin 18 prevents accidental removal of the lifting device from the precast unit 1. The unit 1 may thus be hoisted and transported by a suitable hoisting cable attached to the ring 24. The lifting device 12 may be easily detached from the precast unit and the anchor member 5 used to attach the unit to a building structure, as previously described.

Figures 5, 6, 7:
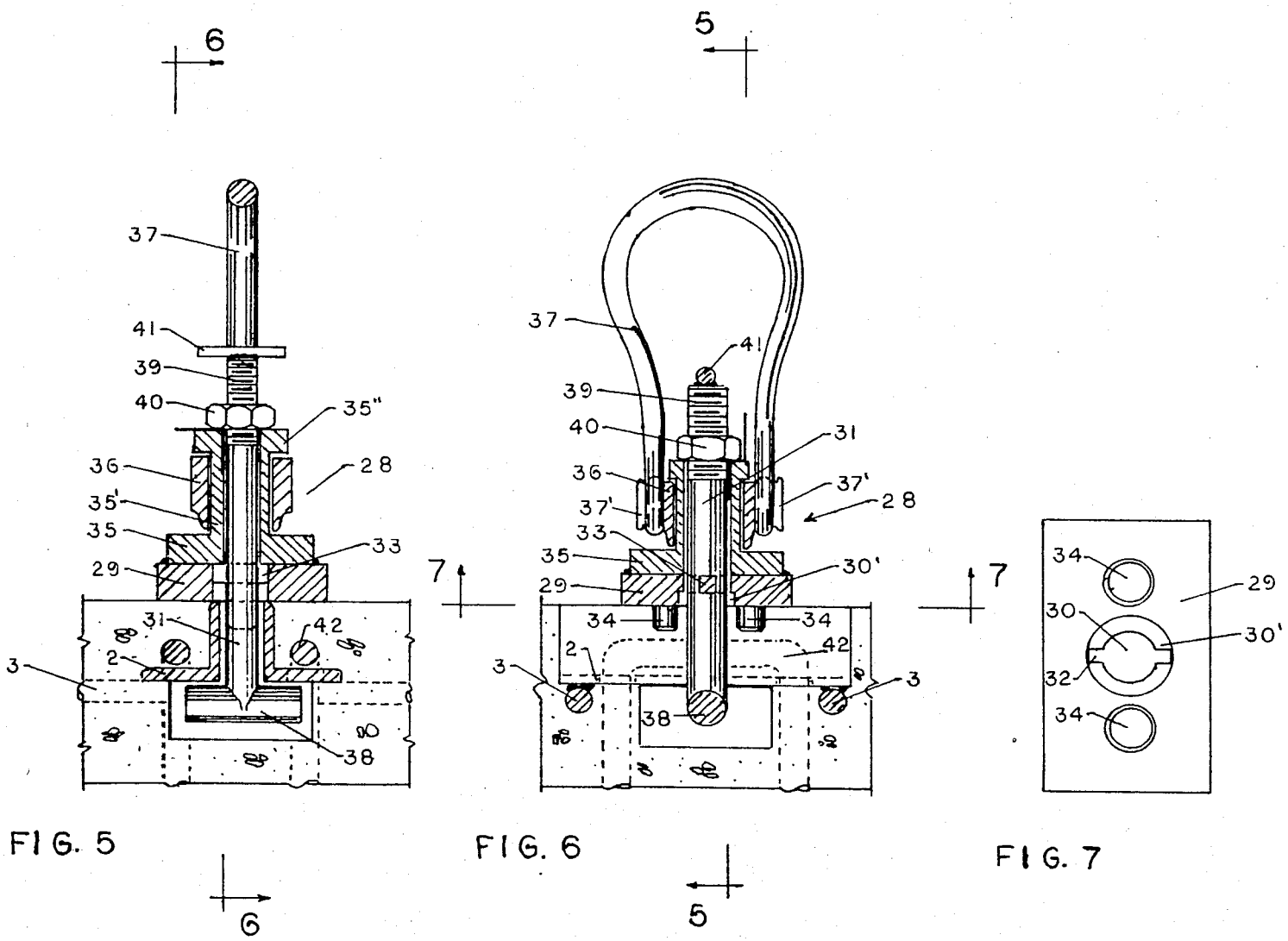
FIG. 5 is a sectional view of a third embodiment for the hoisting and transporting of the precast unit and taken along line 5—5 of FIG. 6.
FIG. 6 is a section taken along line 6—6 of FIG. 5.
FIG. 7 is a plan view of the base plate and taken along line 7—7 of FIG. 6.

FIGS. 5, 6, and 7 show another embodiment of a lifting and hoisting device used more particularly for heavier precast units and also when tilting of the unit is required during its handling. The lifting device is generally indicated at 28 and includes a base plate 29, which has a central hole 30 for slidably receiving the anchoring member 31. The base plate 29 has diametrically-opposite notches 32 in the central hole 30 to receive diametrically-opposite lateral lugs 33 carried by the anchoring member 31. Safety pins 34 are secured to and protrude from the underside of base plate 29 and are adapted to engage the slot between the angle bars 2.

An upper plate 35 is welded, or otherwise rigidly secured, to the base plate 29 on top of the latter and forms a sleeve 35' or guiding support freely surrounding the shank of the anchoring member 31. The upper end of the sleeve 35' is formed by a flange 35'' for retaining on the sleeve 35' a collar 36, which is free to rotate about said sleeve 35'.

A hoisting ring 37 is pivoted on lateral studs fixed to collar 36 for pivotal movement about an axis transverse to that of the shank of anchoring member 31 and, consequently, to the axis of rotation of collar 36 about sleeve 35'. Therefore, ring 37 may pivot with respect to the anchoring member 31 in all planes through the universal joint formed by the collar 36 and the transverse pivotal studs 37'.

The anchoring member 31 has at its inner end a T-shaped head 38, similar to the T-shaped head 7 of the first embodiment, which is adapted to be inserted through the slot between the angle bars 2 and be rotated at right angles within the cavity 4 to extend transversely of the slot in the attached position to precast unit 1.

Rotation of the anchoring member 31 is facilitated by the provision of the grasping rod 41 secured to the outer end of the anchoring member, as by welding or the like.

As shown in FIGS. 6 and 7, the base plate 29 has an annular undercut area 30' surrounding the central hole 30 for receiving lugs 33 and allowing their rotation until they may enter notches 32. The depth of the undercut 30' is at least equal to the vertical thickness of the lugs 33.

The outer end of anchoring member 31 has a threaded portion 39 for receiving a nut 40 which serves to tighten the anchoring member 31 against the underface of angle bars 2 within the cavity 4.

To further strengthen the attachment of the angle bars 2 to the reinforcing armature of the precast unit 1, the angle bars 2 not only are secured to the reinforcing rods 3 by welding, but additional U-shaped reinforcing bars 42 have their web overlying the respective angle bars 2 and their legs extending through holes made in the lateral wings of said angle bars 2, as shown in FIGS. 5 and 6.

The device of FIGS. 5 to 7 is used as follows:

To attach the anchoring member 31 to the precast unit, the nut 40 is partly unscrewed from the tightened position shown in FIG. 6 to allow the lugs 33 to engage the undercut 30' of the base plate 29 with the T-shaped head 38 oriented at right angles to the notches 32. In this position, the T-head 38 is at right angles to the position shown in FIG. 6 and, therefore, the T-shaped head 38 can be inserted through the slot of the cavity 4 until the safety pins 34 engage this slot. The anchoring member 31 is then rotated to 90° by means of transverse grasping rod 41. In this anchoring position, the lugs 33 are in register with the notches 32 and, therefore, the nut 40 can be screwed tight against the flange 35'', thereby firmly applying the transverse legs of the T-shaped head 38 against the underside of the angle bars 2 within the cavity. In this final position, the lugs 33 engage the notches 32 which prevent accidental rotation of the anchoring member with respect to the cavity 4. The precast unit can then be tilted and hoisted by ring 37 and transported without any risk of accidental disengagement of the lifting device from the precase unit.

To detach a lifting device 28 from the precast unit, it is only necessary to unscrew the nut 40, so that the lugs 33 will drop out of register with the notches 32 and then rotate the anchoring member 31 to align the T-shaped head 38 with the slot of the cavity, whereby the lifting device can be removed.

Figure 18:
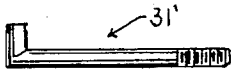
Figure 16:
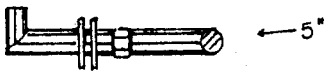
Figure 19:
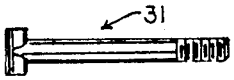
Figure 17:
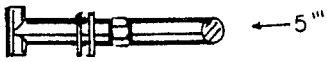

FIGS. 18 and 19 show two different orientations of the T-shaped head of the anchor member 31.

As previously described, the cavity 4 and its associated slot is formed by using a shaped block 43, of foam plastic. However, the cavity can also be formed by securing to the angle bars 2 a box of metal or plastic defining the surfaces of cavity 4 and the end surfaces of the slot and which is left in position after concrete pouring and setting.

We claim:

1. In a handling system for a moldable element, such as a reinforced precast concrete panel, beam or the like, said element including a cavity formed therein adjacent an exposed surface of said element, said cavity communicating with the exterior at said exposed surface by a restricted slot, said cavity having a length at least equal to the length of said slot and a width greater than the width of said slot, said slot and cavity adapted to receive an anchor member having a main straight shank and a transverse leg at one end, the cross-sectional maximum dimension of said anchor member being smaller than the width of said slot and the length of said transverse leg being greater than the width of said slot and smaller than the width of said cavity, whereby said transverse leg can enter said cavity when oriented longitudinally of said slot, rotation of said anchoring member, about the axis of said main leg through a rotated position about a quarter turn, causing said transverse leg to extend in said cavity transversely to said slot and, therefore, secure said anchoring ember to said element, a base plate having a central hole through which the main leg of said anchor member rotatably extends, said base plase having an underface adapted to be applied flat against said exposed surface of said element over said restricted slot, safety pins fixed to said plate on each side of said central hole and protruding from its underface to engage said slot and prevent rotation of said base plate, a guiding support fixed to said base plate opposite said safety pins to rotatably guide said anchor member, said central hole having a lateral notch and said main leg of said anchor member having a laterally-extending lug to engage said notch to prevent rotation of said anchor member with respect to said base plate and guiding support, the outer end portion of said main leg of said anchor member being threaded and further including a nut screwed on said threaded portion and engaging said guiding support.

2. A handling system for a reinforced precast concrete element, such as a panel, beam and the like, comprising, in combination, such an element having an exposed surface, a rigid bar embedded in said element adjacent said exposed surface, an elongated slot opening at said surface and located adjacent said bar, said element having a cavity located inwardly of said bar and communicating with said slot, said cavity having a length at least equal to the length of said slot and a width greater than the width of said slot, said bar being exposed in said cavity and slot, an anchor member having a main straight leg and a transverse leg at its inner end, said main leg having a cross-sectional dimension to closely fit the width of said slot, said transverse leg having a length greater than the width of said slot and smaller than the width of said cavity, rotation of said anchor member about the axis of said main leg to a rotated position about a quarter turn causing said transverse leg to extend in said cavity transverse to said slot and to overlap said bar a hoisting ring carried by the outer end of said anchor member; a support member, secured to said main leg of said anchor member and extending laterally therefrom, said support member being of tubular shape defining a base and a top; a safety pin extending through aligned holes of said base and top, having a head overlying said top; biasing means to bias said safety pin to a locking position in which its inner end protrudes from said base to engage said slot and lock said anchor member in said rotated position, and means to retract said pin to disengage from said slot.

3. A handling system as claimed in claim 2, wherein said biasing means is a compression spring surrounding said safety pin between said base and top.

4. A handling system for a reinforced precast concrete element, such as a panel, beam and the like, comorising, in combination, such an element having an exposed surface, an elongated slot opening at said surface, said element having a cavity communicating with said slot, said cavity having a length at least equal to the length of said slot and a width greater than the width of said slot, two spaced substantially parallel rigid bars embedded in said element, each of angle shape cross-section, each defining a first wing and a second wing, the first wings of said pairs of bars being exposed within said slot and defining the lateral surfaces of the same, the second wings of the pair of bars being oppositely directed and defining the surface of said cavity closest to and parallel to said exposed surface, an anchor member having a main leg and a transverse leg at the inner end, the transverse leg of said anchor member extending on opposite sides of said straight leg to define a T-shaped head with the T-shaped head engaging both second wings of said bars in the rotated position of said anchor member with respect to said slot and cavity; a flanged sleeve member surrounding and rotatable about the main leg of said anchor member, a collar surrounding and rotatable about said sleeve and retained by the flanges of the same, a hoisting ring pivoted to said collar about an axis transverse to the long axis of said main leg, tightening means to tighten the transverse leg of said anchor member against said second wings of said angle bars within said cavity; said sleeve member including a base plate having a central hole through which said main leg of the anchor member freely extends, said base plate being adapted to be positioned flat against said exposed surface of said element with said central hole in register with said slot, said central hole having a lateral notch and said main leg of said anchor member having a laterally-extending lug to engage said notch to prevent rotation of said anchor member with respect to said base plate and sleeve, said base plate having safety pins protruding from the underface thereof and engageable with said slot to prevent rotation of said base plate and sleeve with respect to said slot.

5. A handling system as defined in claim 4, wherein the outer end of said anchor member is threaded, and wherein said tightening means is a nut screwed on said main leg to engage said sleeve.

* * * * *